United States Patent [19]

Risman

[11] 4,392,039

[45] Jul. 5, 1983

[54] DIELECTRIC HEATING APPLICATOR

[75] Inventor: Per O. Risman, Huskvarna, Sweden

[73] Assignee: P.O.R. Microtrans AB, Huskvarna, Sweden

[21] Appl. No.: 226,537

[22] Filed: Jan. 19, 1981

[30] Foreign Application Priority Data

Jan. 21, 1980 [SE] Sweden ..... 8000494

[51] Int. Cl.[3] ..... H05B 6/70

[52] U.S. Cl. ..... 219/10.55 A; 219/10.55 F

[58] Field of Search ..... 219/10.55 F, 10.55 M, 219/10.55 R, 10.55 A, 10.55 D

[56] References Cited

U.S. PATENT DOCUMENTS

| | | | |
|---|---|---|---|
| 2,856,497 | 10/1958 | Rudenberg | 219/10.55 |
| 3,848,106 | 11/1974 | Berggren et al. | 219/10.55 |
| 3,863,653 | 2/1975 | Boudouris et al. | 219/10.55 F |
| 3,980,855 | 9/1976 | Boudouris et al. | 219/10.55 F X |
| 3,999,026 | 12/1976 | Böling | 219/10.55 F |

FOREIGN PATENT DOCUMENTS

| | | | |
|---|---|---|---|
| 1248628 | 10/1971 | United Kingdom | 219/10.55 A |

OTHER PUBLICATIONS

Kashyap et al., "A Waveguide Applicator for Sheet Materials", IEEE Transactions on MW Theory and Techniques, vol. MTT-24, No. 2, pp. 125-126, Feb. 1976.

*Primary Examiner*—B. A. Reynolds
*Assistant Examiner*—Philip H. Leung
*Attorney, Agent, or Firm*—Holman & Stern

[57] ABSTRACT

A dielectric heating applicator has a low-loss dielectric with a dielectric constant exceeding that of the object to be heated by microwaves. An internal resonance is excited in the applicator, which may consist of one or several parts, each containing dielectric, so that a specified field pattern exists at and in the object. Another characteristic is that the part of the object being heated has dimensions which are considerably less than one vacuum wavelength corresponding to the frequency used.

5 Claims, 12 Drawing Figures

DIELECTRIC HEATING APPLICATOR

The present invention relates to microwave heating applicators, including coupling means to a microwave generator. A low-loss dielectric with a dielectric constant $\delta'_r$ higher than that of the load to be heated is included in the applicator, so that an internal resonance is excited in the applicator, causing a specified field pattern to be created at and inside the load. Another characteristic of the invention is that the load to be heated has dimensions smaller than one wavelength in vacuum corresponding to the microwave frequency used.

Microwave applicators employing dielectric materials to guide the wave field are known. Heating applicators designed as dielectric delay lines are described in the Swedish Pat. No. 366 456 (with continuation 373 017). These applicators employ propagation modes where a significant part of the power field flows outside the dielectric. Furthermore, the $\epsilon'_r$ of the dielectric is assumed only to exceed 1 and is thus not specified in relation to the $\epsilon'_r$ of the load. The dimensions of the dielectric must not exceed a specified limit, as only the lowest mode is allowed to propagate. Furthermore, resonance conditions are not assumed due to the propagation.

Microwave applicators of the waveguide type are also known. In these, the microwave energy propagates through a normal metal waveguide with its end in contact to the load to be heated. This principle is further described in e.g. the Swiss Pat. No. 271 419; no specified resonance conditions are created in this applicator type either.

The object of the present invention is to provide an applicator for microwave heating of a body or a zone of a body outside but near or in direct contact to the applicator, which will act as a microwave radiator. This property of the applicator can be achieved by designing it according to the characteristics in the first claim.

Figure 1:
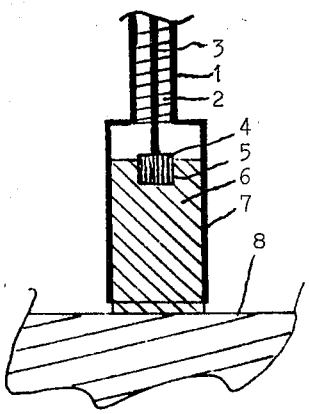
Figure 2:
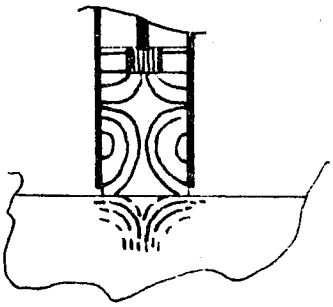
Figure 3:
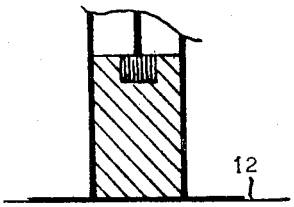
Figure 4:
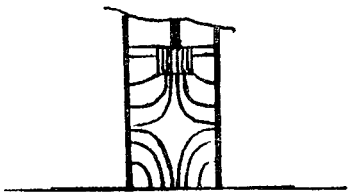
Figure 5:
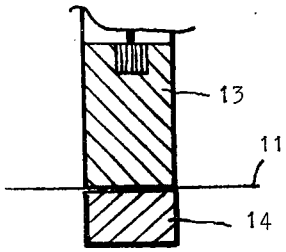
Figure 6:
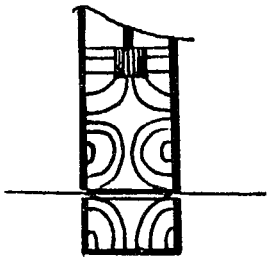
Figure 7:
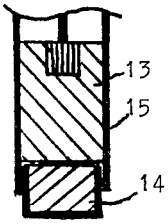
Figure 8:
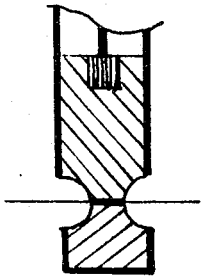
Figure 9:
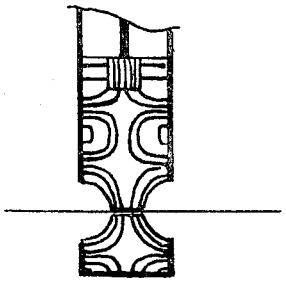
Figure 10:
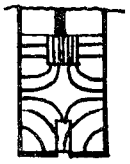
Figure 11:
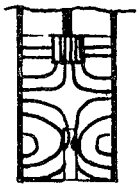
Figure 12:
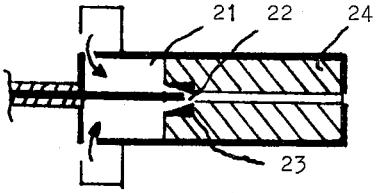

Heating arrangements using several applicators according to the invention will be described below with reference to the accompanying drawings in which:

FIG. 1 is a cross section of an applicator in contact to an object to be heated, FIG. 2 is the same cross section as in FIG. 1 with the field pattern added, FIG. 3 is a cross section of an applicator in contact to a load consisting of a thin sheet, FIG. 4 is the same cross section as in FIG. 3 with the field pattern added, FIG. 5 is a cross section of an applicator consisting of an upper part and a lower, metal-clad dielectric body, both contacting a load consisting of a thin sheet, FIG. 6 is the same cross section as in FIG. 5 with the field pattern added, FIG. 7 is the same applicator as in FIG. 5 but with an extended metal leakage seal, FIG. 8 is a cross section of an applicator with conical ends in contact to a load consisting of a thin sheet, FIG. 9 is the same cross section as in FIG. 8 with the field pattern added, FIG. 10 is a cross section of an applicator with a small axial hole with field pattern included, FIG. 11 is a cross section of another version of the applicator and FIG. 12 is a cross section of an applicator with an axial hole going through the dielectric, adapted for heating of a thin long load.

The general outline of the applicator is shown in FIG. 1, which is a drawing of the cross section of the rotationally symmetrical object. Microwave power is applied by a coaxial line with outer conductor 1, insulating dielectric 2 and center conductor 3. The end of the center conductor is joined to a cylindrical metal antenna 4, which is in very good contact with the inner surfaces of a cylindrical hole 5 in the applicator dielectric 6. This dielectric is mounted in a metal tube 7 which is in very good contact with the cylindrical surface of the applicator dielectric. To further improve the contact between metal and dielectric, this may be metalized. An object to be heated is in direct contact to the plane surface of the dielectric.

The function of the applicator will be described using FIG. 2 which shows the essential microwave parts of FIG. 1 and the electrical field lines of the resonance which will be excited. The cylindrical coaxial antenna will induce a rotationally symmetrical transverse magnetic (TM) wave in the dielectric, which in the preferred embodiment of the invention consists of a ceramic material with a high $\epsilon'_r$ value ($\epsilon'_{rd}$).

In order to achieve a high quality power transfer, the arrangement with the antenna in the cylindrical hole in the dielectric has been found feasible. This design will also make the applicator compact. As the $\epsilon'_r$ of the load to be heated is about 50 (substances with a high water content) at the commonly used microwave frequency 2450 MHz, and the dielectric consists of e.g. sintered titanium dioxide with an $\epsilon'_{rd}$ about 90, the boundary between the two materials will to some extent be a so-called magnetic wall, i.e. the circular magnetic field lines will be confined to the dielectric, causing the E field to acquire resonance character accordingly. This applies when the $\epsilon'_{rl}$ of the dielectric is higher than that of the surrounding medium, i.e. the load to be heated or in a no-load condition; in the latter case the magnetic wall will be still more pronounced. In areas where the dielectric is in direct contact to metal, the conditions will of course be similar to those in an ordinary cavity resonator, i.e. the E field will only have a perpendicular component at the boundary. The radial component of the E field of the cylindrical TM mode which—caused by the chosen dimensions of the dielectric—will be excited will be maximum at (or more precisely somewhat outside) the boundary surface. A certain part of the oscillating energy in the dielectric will leak through the magnetic wall and induce a field pattern in the load 8. This induced field will be of the cylindrical TM 01 type with a pattern determined by the resonance pattern of the dielectric, according to FIG. 2. Maximum field strength will exist along the axis some distance away from the boundary, whereas the field strength at the boundary will be smaller, especially on the axis.

The microwave heating will be determined practically only by the E field as the loss factor $\epsilon''_{rl}$ is less than $\epsilon''_{rl}$ of the load. The heating pattern in the load will therefore be given by the E field as drawn in FIG. 2. The field will of course decrease with distance from the boundary as absorption resulting in heating takes place. The decrease will also be determined by the conditions of aperiodic propagation caused by the complex propagation constant which occurs when the applicator diameter D with the load dielectric constant $\epsilon''_{rl}$ is too small for propagation of the TM 01 mode. The penetration depth will therefore be smaller than 5 . . . 15 mm (power density 1/e of value at boundary) which is the value for plane wave propagation.

For a properly dimensioned applicator, the following criteria must be fulfilled:

The diameter D of the dielectric should be chosen so that the common TM 01 mode may propagate (assuming infinite length) i.e. D should be greater than $\lambda_o/(1.306\sqrt{\epsilon'_{rd}})$ where $\lambda_o$ is the vacuum wavelength corresponding to the frequency. The constant 1.306 is derived from the first zero of the $J_o$ function (2.405) from the relation $\lambda_o=\lambda_k=\pi D/2.405$, where $\lambda_k$ is the critical wavelength for propagation. D should not be appreciably greater than this minimum value. Reasons for this are that the heated zone of the load will otherwise be greater, that unwanted higher resonances may occur, and that the radiation leakage from the applicator under no-load conditions will increase when the diameter is increased. Such leakage will however be significant only when the diameter is increased to the value for the critical wavelength in air which is $\lambda_o/1.306$ for the rotationally symmetrical TM 01 mode.

The height of the dielectric should be chosen for resonance to occur for the frequency used. In FIG. 2 the second lowest mode is drawn, i.e. for an applicator with a height about $(\frac{3}{4})\cdot\lambda_g$ where $$\lambda_g = \frac{\lambda_o}{\sqrt{\epsilon'_{rd}}\sqrt{1-\left(\frac{\lambda_o}{1.306\cdot D\cdot\sqrt{\epsilon'_{rd}}}\right)^2}}$$

There will be higher resonances for applicator heights $(5/4)\cdot\lambda_g$ etc. As a result of the practical dimensioning of the coaxial transition, the magnitude of the ratio $\epsilon'_{rd}/\epsilon'_{rl}$ and eventual requirements on slightly different field patterns in the load, which may be obtained when the applicator resonance is slightly out of tune, the applicator height will normally be determined experimentally. This is preferably made by using a sweep generator, which permits easy identification of the resonances of interest.

The drawings of FIGS. 1 and 2 show that the dielectric is not covered by metal all the way down to the load surface. This modification offers a further possibility to slightly change the field pattern in the load by moving the resonance field in axial direction. The magnetic wall conditions will cause the E field either to be zero or parallel to the boundary, while a metal wall will cause the E field to be perpendicular to the wall with no parallel component. In FIG. 3 the load is a comparatively thin sheet which is placed between the applicator and a metal plate 12. The field pattern will then be the same as in a conventional cavity resonator (FIG. 4), i.e. the E field in the load will be axial and will decrease radially outwards following the $J_o(kr)$ function and have its maximum on the axis. Comparatively high Q-factors may be achieved, resulting in a high power density in the load which may e.g. be plastic sheets welded together.

In FIG. 5 another embodiment is shown where the applicator consists of two parts 13 and 14, both having the same dielectric. The lower part 14 is metalized or metal-clad on the lower circular surface and at least partly on the cylindrical surface. The load 11 is thin but is in this case heated with a ring-shaped maximum, see FIG. 6. This applies especially when the height of the lower part 14 is $\lambda_g/4$. The dividing plane between the parts may of course be made so that combinations of the field patterns according to FIGS. 4 and 6 are obtained. An important advantage of the design according to FIGS. 5 and 6 is, however, that the microwave surface currents along the cylindrical surface are lowest when the height of the lower part 14 is as drawn. This will result in a high Q-factor and in a reduction of the microwave leakage.

A method of reducing the leakage of an applicator system according to FIG. 5 is shown in FIG. 7 where an overlapping cylindrical metal tube 15 is used. The tube may be fixed to any of the parts 13 or 14. There will of course be a requirement that the load diameter should be smaller than the tube diameter.

Means of increasing the field strength of an applicator or an applicator system are shown in FIG. 8. By stepwise or continually reduced diameter of the dielectric in both parts it is possible to achieve a good confinement of the field by magnetic wall action (the surface is more parallel to the E field lines in the dielectric) and a concentration of the field lines to the area between the facing dielectric surfaces so that a point welding action is obtained. The field pattern is shown schematically in FIG. 9, which also shows that the height of the lower part should be about $\lambda_g/2$.

If the load is long and thin and has a diameter much smaller than that of the dielectric it can be heated by a very high field strength by introducing it into or moving it through an axial hole in the dielectric. An embodiment is shown in FIG. 10 where the hole depth is smaller than $\lambda_g/4$ and the rest of the circular lower surface as well as the cylindrical outer surface are metalized. The field pattern is drawn in the same figure. At the high Q-factors which may be achieved in the in principle closed resonator, extremely high field strengths may be obtained inside and close to the hole. Another version is shown in FIG. 11 where the lower circular surface of the dielectric is not metalized, causing the field pattern to be modified and requiring a deeper hole.

Applicators of the types just described can be used for special purposes such as point heating of materials with small dielectric losses or for excitation of gas plasmas. The gas may then pass through an axial hole through the whole applicator; the hole may continue through the transition antenna or in a non-metallic tube or flow through a sealed portion of the space 21 (FIG. 12) between coaxial outer and inner conductors, through holes 22 in the transition antenna 23 in the dielectric 24.

The applicators described here will, properly dimensioned and designed, have a negligible no-load microwave leakage. They do also provide a unique field strength concentration to a small area. It is possible to achieve a heating area as small as some mm in diameter. This means that the embodiments and areas of use are manifold and the principle of this invention is not limited to the embodiments described and shown herein.

What is claimed is:

1. A dielectric heating applicator for heating an object, said applicator comprising:

a hollow cylindrical metal body;

a mass of low-loss dielectric material, having a dielectric constant $\epsilon'_{rd}$, disposed within and in direct contact with said body;

coupling means at one side of said body for feeding microwave energy coaxially to said body from a microwave generator; and means, including the low-loss dielectric material, for forming a resonator at the frequency of the microwave energy fed to said body when an object located at another side of said body is in physical contact with the applicator;

wherein said dielectric constant $\epsilon'_{rd}$ of said dielectric material is greater than the dielectric constant $\epsilon'_{rl}$ of said object.

2. A dielectric heating applicator as claimed in claim 1, wherein the mass of said dielectric material has a height which is determined by the equation:

$$h\frac{4}{n} \approx \frac{\lambda_o}{\sqrt{\epsilon'_{rd}} \cdot \sqrt{1 - \left(\frac{\lambda_o}{1.306 \cdot D \cdot \sqrt{\epsilon'_{rd}}}\right)^2}}$$

where D is the diameter of the dielectric material in said body, $\lambda_o$ the free wavelength corresponding to the microwave energy frequency used and n=1, 3, 5, 7, etc.

3. A dielectric heating applicator as claimed in claim 1 wherein the mass of dielectric material in said body has a diameter D determined according to:

$$D > \frac{\lambda_o}{1.306 \cdot \sqrt{\epsilon'_{rd}}}$$

wherein $\lambda_o$ is the wavelength in a vacuum of the microwave energy used.

4. A dielectric heating applicator as claimed in claim 1, wherein the dielectric material of the applicator is divided in a plane normal to the body axis into upper and a lower parts which decrease in cross-sectional diameter approaching the division.

5. A dielectric heating applicator as claimed in claim 1, further including an axial hole defined through said dielectric material along the full axial length of the dielectric material.

* * * * *